US011677200B2

(12) United States Patent
Muthupandi

(10) Patent No.: US 11,677,200 B2
(45) Date of Patent: Jun. 13, 2023

(54) ELECTRICAL CONNECTOR FOR ADJUSTABLE ILLUMINATED REFRIGERATOR SHELF ASSEMBLY

(71) Applicant: TE Connectivity India Private Limited, Bangalore (IN)

(72) Inventor: Deepan Ponraj Muthupandi, Bangalore (IN)

(73) Assignee: TE Connectivity India Private Limited, Bangalore (IN)

( * ) Notice: Subject to any disclaimer, the term of this patent is extended or adjusted under 35 U.S.C. 154(b) by 0 days.

(21) Appl. No.: 17/884,073

(22) Filed: Aug. 9, 2022

(65) Prior Publication Data

US 2023/0038141 A1 Feb. 9, 2023

(30) Foreign Application Priority Data

Aug. 9, 2021 (IN) ..... 202141035891

(51) Int. Cl.
*H01R 31/06* (2006.01)
*F25D 27/00* (2006.01)
*H01R 33/02* (2006.01)

(52) U.S. Cl.
CPC ..... *H01R 31/06* (2013.01); *F25D 27/00* (2013.01); *H01R 33/02* (2013.01)

(58) Field of Classification Search
CPC ..... H01R 31/06; H01R 33/02; F25D 27/00
See application file for complete search history.

(56) References Cited

U.S. PATENT DOCUMENTS 6,231,205 B1 * 5/2001 Slesinger ..... A47B 97/00 362/225
10,130,196 B2 * 11/2018 Burns ..... A47F 1/12
2012/0063138 A1 * 3/2012 Leadford ..... F21V 29/74 362/249.02
2013/0155723 A1 * 6/2013 Coleman ..... G02B 6/009 362/621
2013/0299439 A1 * 11/2013 Sid ..... A47F 11/10 211/134
2023/0000277 A1 * 1/2023 Wang ..... A47J 27/004

* cited by examiner

*Primary Examiner* — Bryon T Gyllstrom
(74) *Attorney, Agent, or Firm* — Barley Snyder

(57) ABSTRACT

An electrical connector for connecting a light module of an adjustable shelf includes a connector box having a first electrically conductive material electrically connected to a pair of tabs of a frame member formed along a front end of the adjustable shelf, a slide member attached to a side of the connector box and slidable along the frame member to lock the connector box with the adjustable shelf, and a second electrically conductive material having a spring contact positioned on a top side of the connector box. The spring contact is locked to a conductive area of a shelf holder electrically connected to a lead frame of an appliance by sliding the adjustable shelf with respect to the shelf holder. The connector box electrically connects the lead frame and the light module positioned in proximity to the adjustable shelf after the adjustable shelf is mounted to the shelf holder.

14 Claims, 4 Drawing Sheets

ELECTRICAL CONNECTOR FOR ADJUSTABLE ILLUMINATED REFRIGERATOR SHELF ASSEMBLY

CROSS-REFERENCE TO RELATED APPLICATIONS

This application claims the benefit of the filing date under 35 U.S.C. § 119(a)-(d) of Indian Patent Application No. 202141035891, filed on Aug. 9, 2021.

FIELD OF THE INVENTION

The present invention relates to an electrical connector and more particularly relates to an electrical connector for electrically connecting a light module of an adjustable shelf of a refrigerator for illuminating an interior of the refrigerator.

BACKGROUND

Refrigerators have one or more adjustable shelves that facilitate the storage of food and beverage containers of a variety of shapes and sizes. Such shelves are made of transparent materials such as glass and acrylic, or non-transparent materials. A lighting system, such as for example an LED light module, is located on each shelf to provide uniform distribution of light inside the refrigerator. The electrical connection between the lighting system and the refrigerator must be established in such a way that the shelves are easily removable and adjustable to different positions inside the refrigerator.

Conventional adjustable shelves are subject to possible damage due to movement of the shelf after an electrical connection interface is completed and undesirably expose the electrical components. Additionally, electrical connectors for connecting the contacts of a lead frame located on the rear side of the refrigerator wall as well as the contact pads on the refrigerator shelf are placed on the same plane. The problem associated with such an approach is that it may cause failures due to contamination, mechanical stress of the device, or open or short circuits which result in high cost of maintenance of equipment due to failures in the components of the electrical connectors.

SUMMARY

An electrical connector for connecting a light module of an adjustable shelf includes a connector box having a first electrically conductive material electrically connected to a pair of tabs of a frame member formed along a front end of the adjustable shelf, a slide member attached to a side of the connector box and slidable along the frame member to lock the connector box with the adjustable shelf, and a second electrically conductive material having a spring contact positioned on a top side of the connector box. The spring contact is locked to a conductive area of a shelf holder electrically connected to a lead frame of an appliance by sliding the adjustable shelf with respect to the shelf holder. The connector box electrically connects the lead frame and the light module positioned in proximity to the adjustable shelf after the adjustable shelf is mounted to the shelf holder.

BRIEF DESCRIPTION OF THE DRAWINGS

The invention will now be described by way of example with reference to the accompanying Figures, of which.

DETAILED DESCRIPTION OF THE EMBODIMENTS

Figure 1:
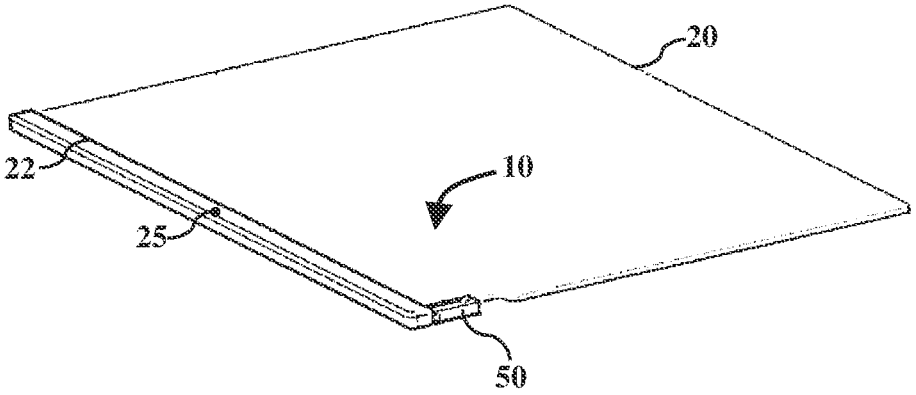
FIG. 1 is a perspective view of an adjustable refrigerator shelf assembly having an electrical connector according to an embodiment.

In the following, numerous specific details are set forth to provide a thorough description of various embodiments. Certain embodiments may be practiced without these specific details or with some variations in detail. In some instances, certain features are described in less detail so as not to obscure other aspects. The level of detail associated with each of the elements or features should not be construed to qualify the novelty or importance of one feature over the others. The particular values and configurations discussed in these non-limiting examples can be varied and are cited merely to illustrate at least one embodiment and are not intended to limit the scope thereof.

The claimed subject matter has been provided here with reference to one or more features or embodiments. Those skilled in the art will recognize and appreciate that, despite the detailed nature of the exemplary embodiments provided here; changes and modifications may be applied to said embodiments without limiting or departing from the generally intended scope. These and various other adaptations and combinations of the embodiments provided here are within the scope of the disclosed subject matter as defined by the claims and their full set of equivalents. Like numbers refer to like elements throughout.

The disclosed embodiments may be better understood by referring to the figures, in which like reference numerals refer to identical or functionally similar elements throughout the separate views, further illustrate the present invention and, together with the detailed description of the invention, serve to explain the principles of the present invention.

The present invention relates to an electrical connector for electrically connecting a light module of an adjustable refrigerator shelf assembly that is capable of preventing damage or disconnection. The electrical connector is capable of establishing firm electrical contact with the refrigerator as well as the light module. This invention establishes firm electrical contact only if the shelves are adjusted to a fully loaded position. The electrical connector is quick and easy to adjust, is relatively inexpensive, and is usable with existing cabinets and mounting racks. The adjustable refrigerator shelf assembly in association with the electrical connector is effectively assembled and adjusted based on various dimensions of an adjustable shelf and simplifies the installation process.

An adjustable refrigerator shelf assembly 10 having an electrical connector 50 according to an embodiment is shown in FIG. 1. The adjustable shelf assembly 10 for a refrigerator 75, shown in FIG. 4, generally includes an adjustable shelf 20 having a frame member 22 formed along its front end. In an embodiment, the refrigerator 75 generally includes one or more adjustable shelves 20 that are movable within the refrigerator 75 to allow for the flexible storage of items in the refrigerator 75. The frame member 22 overlaps the front edge of the adjustable shelf 20 and a light module 25 and runs along the front edge of the adjustable shelf 20, as shown in FIG. 1.

The light module 25 is positioned in proximity to the adjustable shelf 20. The light module 25 of the adjustable shelf 20 is positioned within the frame member 22 and beneath the adjustable shelf 20 to illuminate the adjustable shelf 20 and/or an area beneath the adjustable shelf 20, based on design consideration. The light module 25 in the shown embodiment is attached to the center of the adjustable shelf 20, however, additional and/or alternative configurations may be used. In an embodiment, the light module 25 is comprised of a plurality of light emitting diodes.

Figure 2:
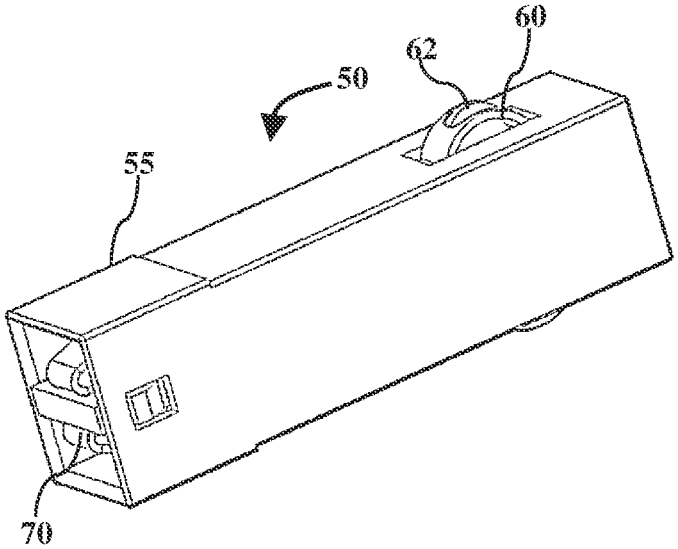
FIG. 2 is a perspective view of the electrical connector.
Figure 3:
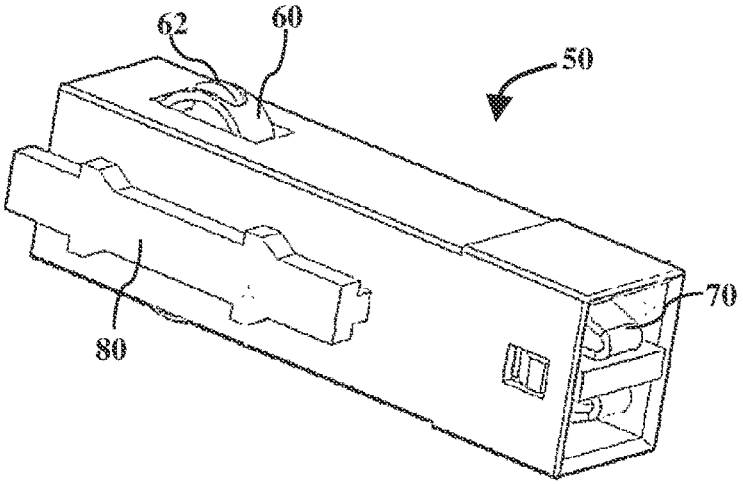
FIG. 3 is a side view of the electrical connector.

The shelf assembly 10 further includes an electrical connector 50, shown in FIGS. 1-3, for electrically connecting the light module 25 and the adjustable shelf 20. The adjustable shelf 20 connected to the electrical connector 50 discussed herein is generally used to conduct electricity to shelves in refrigerators. It can be appreciated, however, that such embodiments can be implemented in the context of other configurations such as a side-by-side refrigerator, a top-freezer refrigerators, and in any other appliances including, but not limited to, a freezer, a washing machine, a dryer, a stove, a microwave, a dishwasher, a shelving unit, a refresher, etc., or in any other apparatus, device, installation, etc. having shelves to which conducting electricity is desired and/or needed, based on design consideration.

As shown in FIG. 2, the electrical connector 50 includes a connector box 55. In an embodiment, the connector box 55 is substantially rectangular in shape, based on design consideration. The connector box 55 includes a includes a first electrically conductive material 70 located on a front side of the connector box 55 and a slide member 80 attached along at least one side of the connector box 55, as shown in FIG. 3. The connector box 55 further includes a second electrically conductive material 60 having a spring contact 62 positioned on a top side of to the connector box 55.

Figure 4:
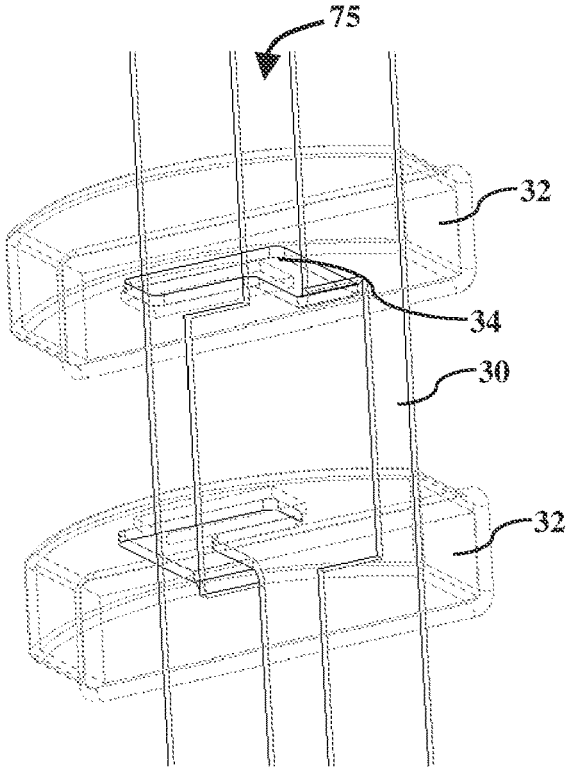
FIG. 4 is a rear perspective view of a refrigerator according to an embodiment.

In FIG. 4, a rear side view of the refrigerator 75 showing a lead frame 30 for electrical connection inside the refrigerator 75 is illustrated, in accordance with an exemplary embodiment of the present invention. The lead frame 30 is a metal structure inside a chip package that carries signals from the refrigerator 75 to the outside. In general, the lead frame 30 consists of a central die pad, where the die is placed, surrounded by leads, with metal conductors leading away from the die to the outside. Mechanical connections fix all these parts into a rigid structure, which makes the whole lead frame 30 easy to handle automatically.

Figure 5:
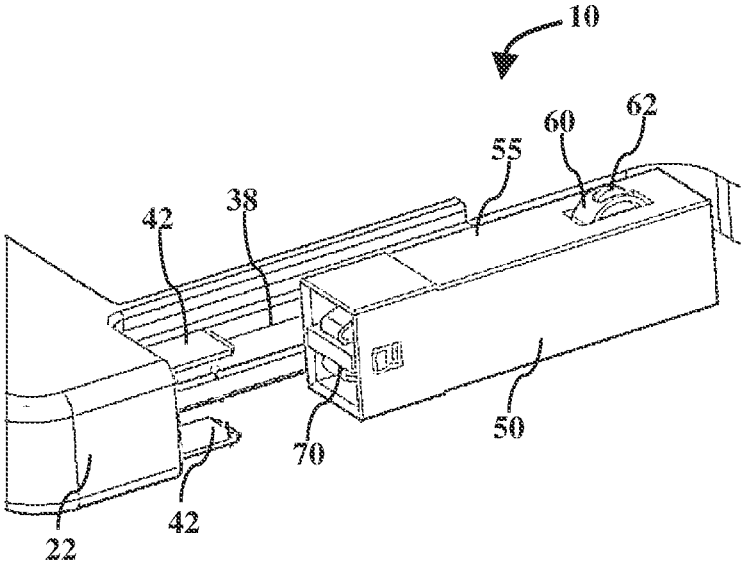
FIG. 5 is a perspective view of the electrical connector and a frame member prior to connection.
Figure 6:
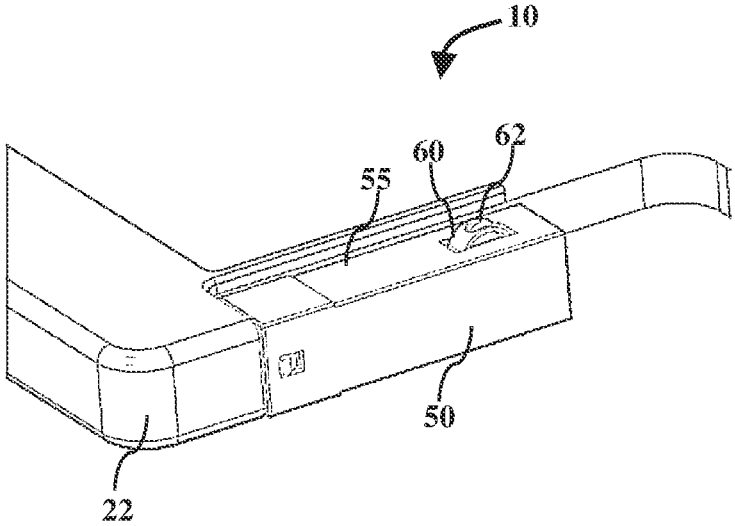
FIG. 6 is a perspective view of the electrical connector and the frame member after connection.
Figure 7:
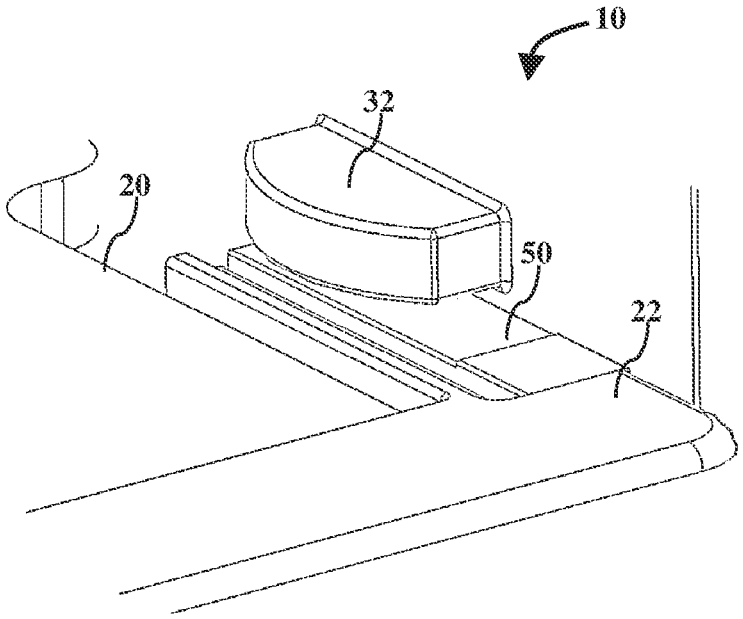
FIG. 7 is a perspective view of the electrical connector connected with the frame member and a shelf holder.

In FIGS. 5-7, perspective views of the electrical connector 50 that connects the lead frame 30 and the light module 25 attached inside the frame member 22 of the adjustable shelf 20 is illustrated, in accordance with an exemplary embodiment of the present invention. A shelf holder 32 is disposed on both sides of the refrigerator 75 for slidably holding the adjustable shelf 20 at a desired height as shown in FIG. 7. The adjustable shelf 20 further includes a pair of tabs 42 located on the edge of the frame member 22 attached to the front end of the adjustable shelf 20.

The slide member 80 attached to one side of the connector box 55 slides via rails 38 formed on sides of the frame member 22, shown in FIG. 5, to lock the connector box 55 with the adjustable shelf 20. The first electrically conductive material 70 at the front side of the connector box 55 is electrically connected to the tabs 42 of the adjustable shelf 20 in the fully loaded or securely mounted position. The second electrically conductive material 60 having the spring contact 62 positioned on the top side of the connector box 55 is locked to the conductive area 34 of the shelf holder 32, shown in FIG. 4, that is connected to the lead frame 30 at a rear side of the refrigerator 75 by sliding the adjustable shelf 20 with respect to the shelf holder 32. The second electrically conductive material 60 is electrically connected to the lead frame 30 through the conductive are 34. The connector box 55 establishes secure electrical connection between the lead frame 30 and the light module 25 attached inside the frame member 22 of the adjustable shelf 20 after the adjustable shelf 20 is securely mounted.

The electrical connector 50 establishes electrical connection between the lead frame 30 and the light module 25 only when the adjustable shelf 20 is in a fully loaded position. The first electrically conductive material 70 and the second electrically conductive material 60 of the electrical connector 50 are placed apart to prevent short circuit. The electrical connector 50 establishes firm electrical contact between the refrigerator 75 and the light module 25. The adjustable shelf 20 is easily adjustable to a plurality of different positions inside the refrigerator 75.

The present invention is easy to assemble and save time and additional process in the assembly line. The electrical connector 50 is easily attached between the adjustable shelf 20 and the shelf holder 32. Adjustability is achieved by using the refrigerator shelf assembly 10 having the electrical connector 50 to accommodate different thickness of the adjustable shelf 20. The electrical connector 50 can readily adapt to a variety of ranges of operation, is used with existing cabinets and mounting racks, has a comparatively low cost of construction, is readily assembled, presents a low risk of damage to the inner electrical components during assembly or operation, and is accurate and reliable in operation.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrical connector for connecting a light module of an adjustable shelf, comprising:

a connector box having a first electrically conductive material at a front side electrically connected to a pair of tabs on an edge of a frame member formed along a front end of the adjustable shelf;

a slide member attached to a side of the connector box and slidable along a plurality of rails formed on the frame member to lock the connector box with the adjustable shelf; and a second electrically conductive material having a spring contact positioned on a top side of the connector box, the spring contact is locked to a conductive area of a shelf holder electrically connected to a lead frame of an appliance by sliding the adjustable shelf with respect to the shelf holder, the connector box electrically connects the lead frame and the light module positioned in proximity to the adjustable shelf after the adjustable shelf is mounted to the shelf holder.

2. The electrical connector of claim 1, wherein the light module is positioned within the frame member and beneath the adjustable shelf.

3. The electrical connector of claim 2, wherein the light module is a plurality of light emitting diodes.

4. The electrical connector of claim 1, wherein the connector box has a rectangular shape.

5. The electrical connector of claim 1, wherein the first electrically conductive material and the second electrically conductive material are spaced apart.

6. The electrical connector of claim 1, wherein the electrical connector electrically connects the lead frame and the light module only when the adjustable shelf is in a fully loaded position.

7. An adjustable shelf assembly, comprising:

an adjustable shelf having a frame member along a front end;

a light module positioning in proximity to the adjustable shelf;

a shelf holder slidably holding the adjustable shelf and having a conductive area electrically connected to a lead frame; and an electrical connector electrically connecting the light module to the lead frame after the adjustable shelf is mounted to the shelf holder, the electrical connector including a connector box having a first electrically conductive material at a front side electrically connected to a pair of tabs of the frame member, a slide member attached to a side of the connector box and slidable along a plurality of rails formed on the frame member to lock the connector box with the adjustable shelf, and a second electrically conductive material having a spring contact positioned on a top side of the connector box, the spring contact is locked to the conductive area of the shelf holder.

8. The adjustable shelf assembly of claim 7, wherein the light module is positioned within the frame member and beneath the adjustable shelf.

9. The adjustable shelf assembly of claim 7, wherein the light module has a plurality of light emitting diodes and illuminates the adjustable shelf and an area beneath the adjustable shelf.

10. The adjustable shelf assembly of claim 7, wherein the electrical connector electrically connects the lead frame and the light module only when the adjustable shelf is in a fully loaded position.

11. The adjustable shelf assembly of claim 7, wherein the first electrically conductive material and the second electrically conductive material are spaced apart.

12. The adjustable shelf assembly of claim 7, wherein the adjustable shelf assembly is part of a refrigerator.

13. The adjustable shelf assembly of claim 12, wherein the adjustable shelf is adjustable to a plurality of positions inside the refrigerator.

14. The adjustable shelf assembly of claim 13, wherein the shelf holder is disposed on a pair of opposite sides of the refrigerator and slidably holds the adjustable shelf at a desired height.

* * * * *